US005553352A

United States Patent [19]

Bolton

[11] Patent Number: 5,553,352

[45] Date of Patent: Sep. 10, 1996

[54] BIFOLD DOOR REPAIR APPARATUS

[76] Inventor: John D. Bolton, 6 Waterway, Irvine, Calif. 92714

[21] Appl. No.: 312,035

[22] Filed: Sep. 26, 1994

[51] Int. Cl.[6] ..... E05D 7/10

[52] U.S. Cl. ..... 16/229; 16/386

[58] Field of Search ..... 16/229, 380, 386, 16/387, 388, 392; 160/199, 206, 210, 213

[56] References Cited

U.S. PATENT DOCUMENTS 3,187,800 6/1965 Kirby ..... 160/206
3,221,804 12/1965 Rudnick ..... 160/206
3,285,324 11/1966 Stein et al. ..... 16/229
4,620,392 11/1986 Kerpers et al. ..... 16/229
4,799,529 1/1989 McAfee ..... 160/206

*Primary Examiner*—Chuck Y. Mah

[57] ABSTRACT

An apparatus is described for conveniently repairing broken bifold doors and especially where the operating pivot pin is loose. The apparatus consists of a heavy "L" shaped bracket which has a retractable pivot pin installed in it. The bracket with installed pivot pin are simply screwed onto the split corner of the bifold door, repairing the door and replacing the old pivot pin with a new securely anchored pivot pin, all in one operation.

1 Claim, 1 Drawing Sheet

BIFOLD DOOR REPAIR APPARATUS

BACKGROUND OF THE INVENTION

Figure 1:
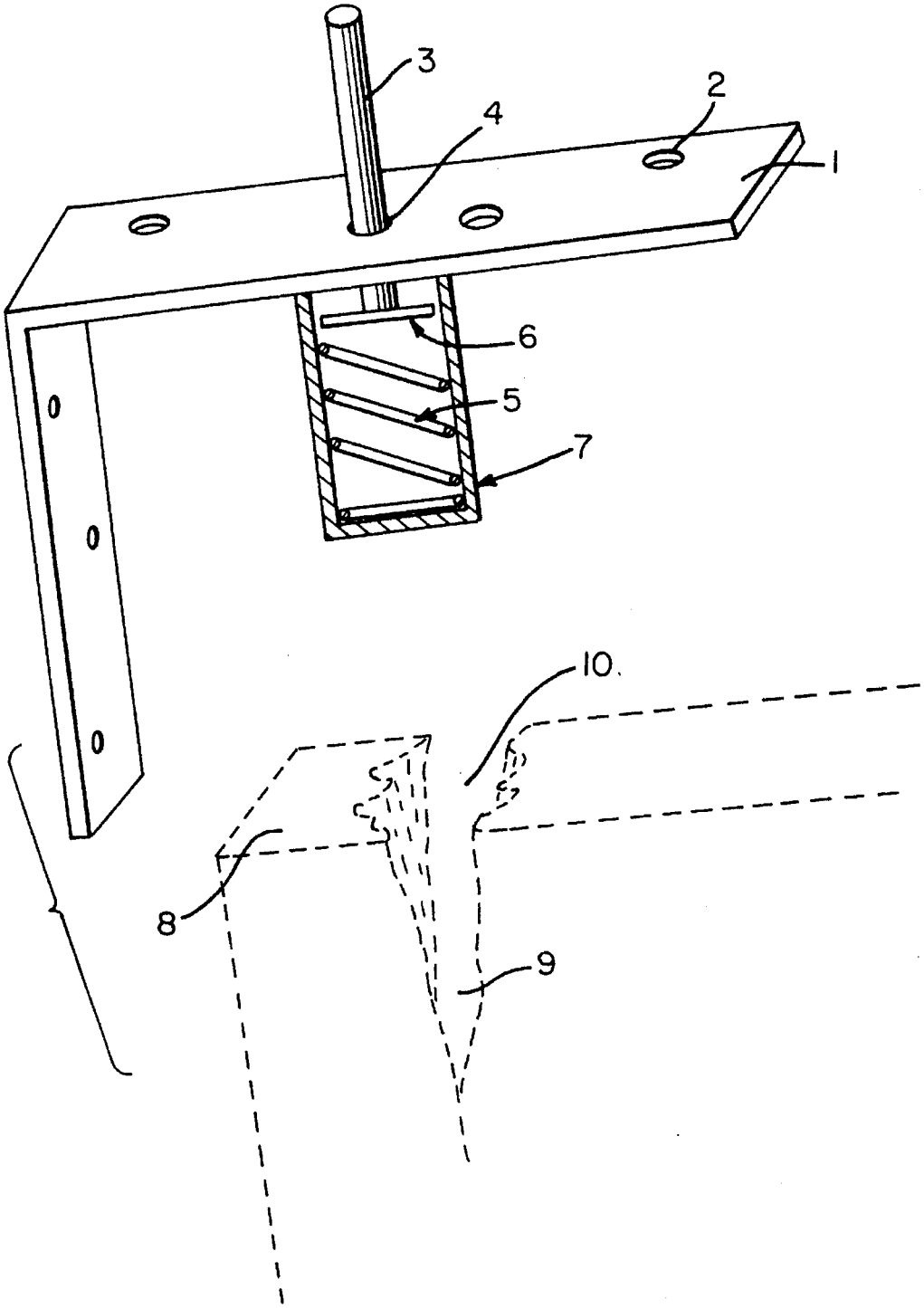

Bifold doors are doors that fold against each other "accordion style" as opposed to doors that swing open. They are frequently used in homes and apartments for closet doors because they take less space than a traditional "swing" door".

Bifold doors have a pivot pin inserted in the stile, (the vertical board in the edge of a door), at the top and bottom of the part of the pair of doors installed nearest the vertical door jam. When the bifold doors are installed those pivot pins are inserted in pivot pin bearings at the top and bottom of the door jam. A second pin or roller is inserted in the top of the door farthest from the first door jam. This pin or roller is inserted up into an inverted "U" channel affixed to the top of the door jam. The pair of bifold doors are joined together by a hinge along their common vertical edges.

As the bifold doors are drawn open, the pivoted ends of the doors rotate on the pivot pins. This cause the hinged edge of the pivot pin door to trace an arc. Since the two doors are hinged together, the hinge pulls the edge of the second door back, towards the pivot pin jam. This causes the distant end of the pair of doors to be drawn back toward the pivoted ends. The distant end guide pin or roller inserted in the track, securely guides the distant end of the doors back toward the door jam. As the distant end is drawn back, the pair of doors fold against each other along the hinge which joins them.

As installed, the bifold doors pair are cantilevered out from the pair of pivot pins. The weight of the extended pair of doors pulling down exerts a tension across the grain of the stile in the top of the pivot pin door. The stile of the pivot pin door has already been weakened by drilling a hole in it to insert the pivot pin. Eventually, due to drying wood or use of excessive force on the door, the stile of the door is pulled open along the grain, almost always at the point of the drilled hole for insertion of the pivot pin. When that happens, the door opens up, the pivot pin is released, and the whole system becomes unusable.

Previously, the only way to repair the problem was to replace the door. This involved finding a matching door, finding hardware that was compatible with the hardware that was installed in the door jam and the existing door, fitting the new door to the existing door, fitting the new door to the existing opening, installing the hardware, trying to match the paint color of the new paint with the paint on the existing door and then painting the new door. At best the whole process was a labor intensive, expensive, time consuming undertaking. Frequently, a matching door or compatible hardware cannot be found and all the doors, hardware and tracks have to be replaced.

PRIOR ART AND REFERENCES

U.S. Pat. No. 3,662,808 describes a bifold door hardware. U.S. Pat. No. 5,080,160 describes a track and pivot bracket for bifold doors. U.S. Pat. No. 3,810,338 describes a metal reinforced plastic panel for a bifold door.

OBJECT OF THIS INVENTION

The object of this invention is to describe an apparatus to conveniently repair a bifold door when the bifold door stile is split open and the door is no longer usable. It is an object of this invention to describe an apparatus that will eliminate the need to find matching doors or matching hardware, to avoid all of the fitting and paint matching tasks and to save a great deal of time and expense in the process.

THE DRAWING

FIG. 1 shows a large relatively thick, "L" shaped bracket, 1, with openings, 2, to receive screws. A pivot pin, 3, is placed in a hole, 4, in the "L" shaped bracket. The hole 4 is very slightly larger than the pivot pin, 3, the said hole allowing the pivot pin 3 to move through the said hole 4 freely, but at the same time the said hole 4, restraining movement of the pivot pin to movement at right angles to the surface of the said "L" shaped bracket 1.

The portion underneath the apparatus is shown in cross section to aid in clarity of this description. A compression spring, 5, is placed between a disk, 6, fixed to the pivot pin 3, and the inside base of a (tube) housing, 7. The length of the compression spring, 5, is such that it must be compressed slightly to be inserted between the fixed pivot pin washer, 6, and the base of the tube housing 7.

A detail of the corner of a split bifold door is shown as a phantom drawing, 8,9,10. The bifold door is not part of this invention but is shown in the drawing to clarify the suggested use of the apparatus. The corner of the bifold door, 8, has moved away from the body of the door, resulting in a split, 9, releasing the bifold door pivot pin that was formerly installed there in the drilled hole, 10. The door, as shown, is unusable.

USE OF THE APPARATUS

The user places the relatively heavy metal "L" bracket, 1, against the outside corner of the bifold door 8, placing the spring housing tube 7 in the opening 10, leer by the old pivot pin. The user screws the apparatus to the bifold door by passing screws through the openings 2 in the "L" shaped bracket into the corner of the bifold door 8 and into the top of the bifold door.

OPERATION OF THE APPARATUS

To install the bifold doors in the existing top door jam the user inserts the compressible pivot pin, 3, into the top pivot pin bearing located in the top jam, (not shown), and raises the bifold doors until he can swing the lower pivot pin over the floor pivot pin bearing, (not shown). In raising the bifold doors he compresses the pivot pin, 3, down into the "L" shaped bracket, 1, through the opening, 4, against the compression spring, 5. Then he lets the lower bifold door pivot pin drop into the lower existing pivot pin opening and allows the bifold doors to drop until the lower bifold door pivot pin is seated in the lower bifold door pivot bearing.

When the bifold doors descend into the floor pivot pin bearing, the upper pivot pin, 3, is forced upward by the compression spring 5, and continues to extend from the "L" shaped bracket 1, compensating for the lowering of the doors, until it is the maximum possible length is inserted in the upper door jam pivot pin bearing. This automatic extension assures that the bifold doors are securely held in place. The automatic feature also insured secure attachment of the bifold doors when the jam moves due to drying, building settlement or earthquake.

From then on the user can use the bifold doors in the normal manner. The relatively heavy "L" metal bracket holds the door together so the split, and the bifold door, are permanently and effectively repaired. The new pivot pin housing is welded to the "L" shaped bracket so that the pivot pin is firmly fixed and held in a permanent and ridged position. Since the apparatus is usually an all metal apparatus, and can resist tension much better than wood, the bifold doors are actually improved, and are likely to remain serviceable far longer than wood doors without a bracket ever could.

PREFERRED EMBODIMENT

This is one selected embodiment of my invention chosen to illustrate the concept. My invention is not limited to this particular embodiment.

The pivot pin is shown in the drawing cut off at the fixed disk. It is within my concept to use a washer with a central opening instead of a disk, and extend the pivot pin through the opening in the washer, down, through the compression spring, and even through the base of the tube housing. My concept includes the embodiment where the pivot pin is hollow, the compression spring rises inside it and the tube housing fits the pivot pin relatively snugly.

My application describes a spring to extend the pivot pin. However an means may be substituted to accomplish my concept which is to extend and retract the pivot pin. An alternative to a spring within the concept of this invention is a threaded pivot pin in a threaded hole in the "L" shaped bracket.

My concept is not limited to upper pivot pins, but extends to lower load bearing pivot pins and the sliding track pin sometimes with the addition of a coaster wheel. The described "L" shaped bracket may be a flat bar extending to the end of the door without the downward projection. The said "tube" shaped housing may be any shape.

This applicant is aware of all of these alternative forms and all of the alternatives that accomplish the same things are within the concept of this invention.

The terms "over" and "under" and "base" are used to aid in the clarity of this description and refer to a frequently used position of installation of the "L" shaped bracket. However my concept is not limited by these terms, and installation of the "L" shaped bracket and movement of the pins in any direction is within the concept described in this application.

ADVANTAGES OF MY INVENTION

The advantage of my invention is that the user can quickly and conveniently repair a broken bifold door, at minimal cost and with little labor, and end up with a new, ridgidly attached pivot pin installed in the proper position.

A repair kit for bifold doors with an "L" shaped bracket but with a non-compressable pivot pin has been previously described. This apparatus is not practical to use because, having inserted the upper fixed pin in the top jam bearing it is impossible to raise the bifold doors enough to swing the lower pivot pin over the lower pivot pin bearing. If the user tries to cut the upper fixed pivot pin short enough to install the footer pin, the fixed upper pin is too short to remain firmly installed in the upper pivot pin opening after the bifold doors drop down into the lower pivot pin bearing.

The advantage of my invention over the above concept is that my pivot pin can be conveniently compressed for installation, but upon release extends up into the jam to securely hold the bifold doors in place. No cutting is necessary.

Having thus described my invention I claim:

1. A bifold door repair apparatus consisting of:

an L-shaped bracket having two arms, one of said arms having a through opening;

a pin having an upper portion and a lower portion, said lower portion having an enlarged base; said pin being slidably received in said opening;

a tube housing having a closed lower end and an open upper end, said open upper end being attached to said one arm concentrically around said through opening; the lower portion of said pin being enclosed in said tube housing, and a compressed spring being placed between the closed lower end of said tube housing and the enlarged base of said pin so that the compressed spring tends to force the pin through and out of said through opening.

* * * * *